US005509744A

United States Patent [19]

Frazier

[11] Patent Number: 5,509,744

[45] Date of Patent: Apr. 23, 1996

[54] LIQUID APPLICATOR WITH SLIDE RING ACTIVATOR

[76] Inventor: Thomas G. Frazier, c/o J. Penner Corporation, 17 Welden Dr., Doylestown, Pa. 18901

[21] Appl. No.: 494,581

[22] Filed: Jun. 23, 1995

[51] Int. Cl.[6] ..... A47L 1/15; A47L 13/16

[52] U.S. Cl. ..... 401/132; 401/133; 401/196; 604/3

[58] Field of Search ..... 401/196, 132, 401/133; 604/3

[56] References Cited

U.S. PATENT DOCUMENTS 3,891,331 6/1975 Avery ..... 401/132

4,027,985 6/1977 Loesser, III ..... 401/196 X 4,784,506 11/1988 Koreska et al. ..... 401/132

*Primary Examiner*—Steven A. Bratlie

*Attorney, Agent, or Firm*—Z. T. Wobensmith, III

[57] ABSTRACT

An applicator for dispensing liquids which comprises, a thin walled elongated tube like plastic container which has an ampule therein which contains liquid to be dispensed. The container has an opening at one end with a sponge thereon, and a slide ring activator mounted to the tube, which is restrained from longitudinal movement by positioning bumps, which slide ring for applicator activation is rotated about the tube's axis to apply inwardly directed forces on both sides of the ampule to cause it to break, and liquid to flow to the opening, and thence to the sponge from which it is applied.

8 Claims, 3 Drawing Sheets

LIQUID APPLICATOR WITH SLIDE RING ACTIVATOR

BACKGROUND OF THE INVENTION

1. Field of the Invention

This invention relates to a tube like applicator for liquid dispensing from a self contained crushable liquid filled ampule which is activated by a rotatable slide ring.

2. Description of the Prior Art

Applicators for dispensing liquids for various uses and which are primarily of the single use throw away type are known in the art. Such applicators take many forms, but the common factor is that a thin walled glass ampule is provided to contain the liquid, which is then encased in an outer casing, which can be a cardboard or plastic tube, the ampule is crushed for use by squeezing it between the fingers of the user or by an external lever. There are many considerations that must go into the design of liquid applicators. They must be easy to activate, the glass must be contained in the tube after breakage, the cost must be minimal, and the device must be easy to use.

Devices that utilize a lever positioned near the dispensing end of the applicator are known. The sealing of the glass ampules and the geometry of the sealed ends causes the ends of the ampules to be thicker than the walls, which results in greater forces required to break the ampules. When the contents of the ampule are above 2–3 milliliters the wall thickness is increased considerably, and the force required to crush it is greater since the effort required to break the ampule wall increases exponentially as the thickness of the wall increases. In ampules with contents above 2–3 milliliters, the wall thickness must be increased to maintain the integrity of the ampule.

The U.S. Patents to Avery U.S. Pat. Nos. 3,891,331 and 4,183,684 discuss some of the problems associated with larger ampoules, which they do not solve. The U.S. Patent to Arcudi U.S. Pat. No. 3,466,131 is also pertinent, but the ampoule cannot be broken between the fingers in the larger ampoule sizes.

The 3M COMPANY provides a Duraprep applicator which utilizes a "lever" to break the glass ampoule, but is subject to the same problems, i.e. as a larger fill is required, a thicker ampoule is required which in turn requires larger forces to crush.

The lever type of ampule activator requires considerable force as it only applies force to one side of the ampule, and the wall thickness of the surrounding container accordingly must be increased to accommodate the larger size and quantity of glass particles produced by activation.

The slide ring applicator of the invention is located at the thinnest portion of the ampule, and provides a one hand operation where force is applied inwardly to both sides of the ampule by twisting the slide ring, which structure obviates the problems posed by the prior art devices and provides many positive advantages.

SUMMARY OF THE INVENTION

The invention is directed to a liquid applicator device which has a slide ring activator. The liquid applicator consists of an outer tube like thin walled plastic container, which holds a glass ampule filled with liquid, which can hold two millimeters or larger, with the liquid after crushing of the ampule dispensed through a sponge on the end of the applicator, the sponge being in communication with the interior of the container through an opening.

A slide ring activator is provided on the outside of the device, and positioned thereon by two bumps in the container top wall. The slide ring can be twisted by a one hand operation to apply force inwardly to both sides of the glass ampule to crush it and permit liquid to flow out onto the sponge for use.

The principal object of the invention is to provide a liquid applicator with a slide ring activator that can be easily activated by one hand operation to crush an ampule on both sides, which provides effective dispensing of the liquid contained therein.

A further object of the invention is to provide a liquid applicator of the character aforesaid wherein the body of the applicator may be bent upwardly to a position which provides better liquid flow and enhanced application of the liquid by the sponge tip.

A further object of the invention is to provide an applicator which requires less force to activate than prior devices.

A further object of the invention is to provide an applicator of the character aforesaid which is simple and inexpensive to construct and is suitable for mass production.

A further object of the invention is to provide an applicator of the character aforesaid which is safer than prior art devices both prior to and after activation.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
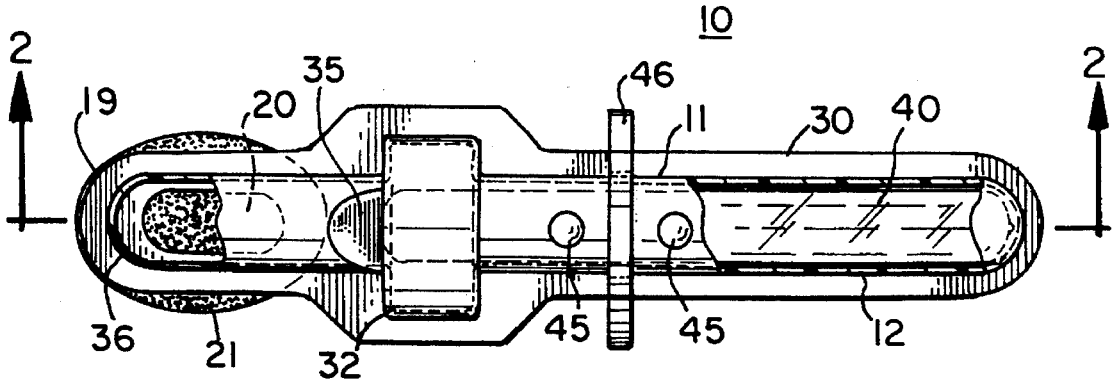
FIG. 1 is a top plan view partially broken away of one embodiment of the liquid applicator device of the invention.
Figure 2:
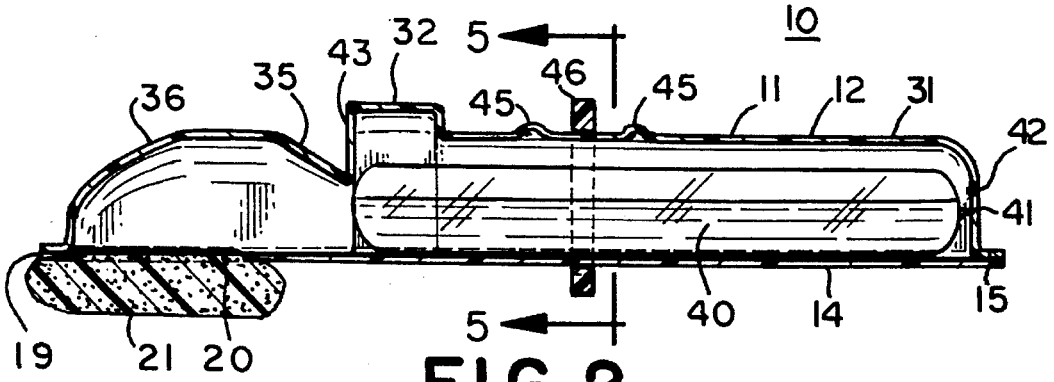
FIG. 2 is a vertical sectional view taken approximately on the line 2—2 of FIG. 1.

It should, of course, be understood that the description and drawings herein are merely illustrative, and that various modifications and changes can be made in the structure disclosed without departing from the spirit of the invention.

Like numerals refer to like parts throughout the several views.

DESCRIPTION OF THE PREFERRED EMBODIMENTS

When referring to the preferred embodiments, certain terminology will be utilized for the sake of clarity. Use of such terminology is intended to encompass not only the described embodiments, but also technical equivalents which operate and function in substantially the same way to bring about the same result.

Referring now more particularly to the drawings and FIGS. 1–5 thereof one embodiment of the applicator device 10 is therein illustrated.

The device 10 includes an outer elongated tube like container 11 which has an upper member 12 and a lower member 14.

The lower member 14 is flat, with a rear curved end 15, a rectangular center 16, an intermediate wider portion 17, and a front portion 18 with a frontal rounded edge 19, an opening 20 therein for liquid flow and a sponge applicator 21 secured thereto by adhesive and in communication with opening 20.

The lower member 14 is preferably formed of a relatively stiff plastic material and preferably from sheet polyethylene.

The upper member 12 is of hollow U-shaped configuration in cross section, and also preferably formed of polyethylene plastic which is flexible and capable of being injection molded.

The upper member 12 has a perimeter lip 30 which extends therearound of the same outside configuration as lower member 14 as described above, and is fastened to lower member 12 by any suitable means with heat sealing being preferred. The upper member 12 at the rear thereof has a raised hollow body 31, which is of U-shape in cross section and integral with lip 30 forming a chamber 21. The body 31 extends forwardly to a raised collar 32 of the same configuration, but taller and wider than body 31, which is also integral therewith and with lip 30.

Figure 4:
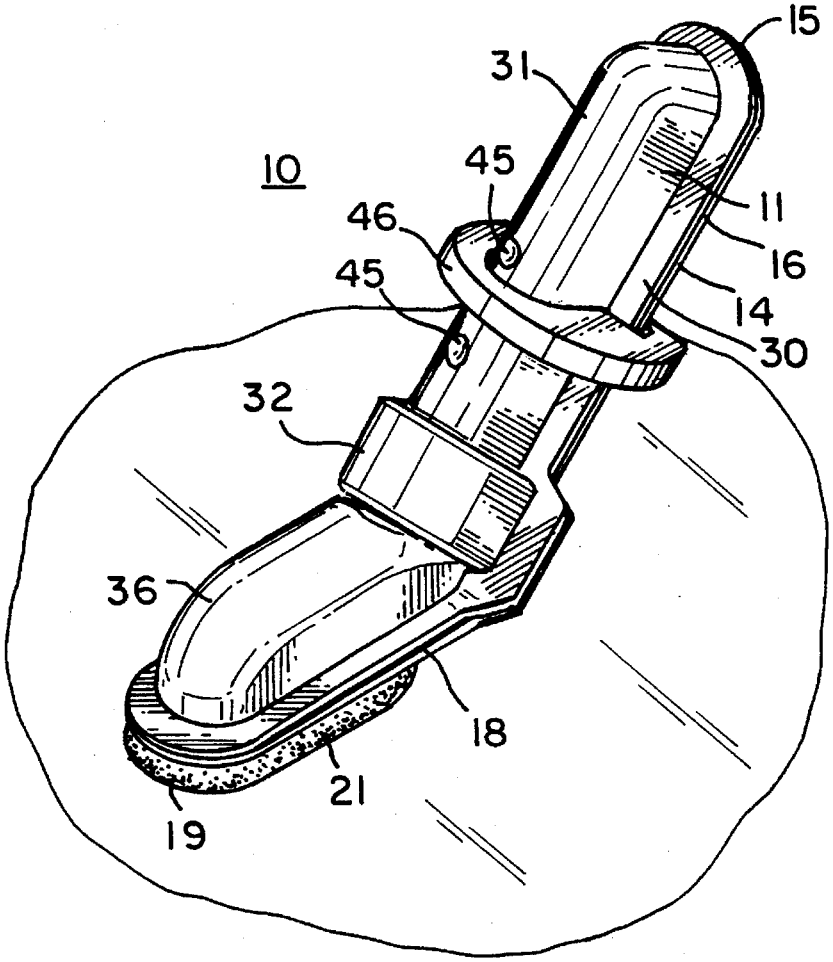
FIG. 4 is a perspective view in operating condition of the device of FIG. 1.

In front of collar 32 an angular wall 35 is provided, which is part of a front end 36, which is integral with lip 30 and collar 32. The angularly related connecting wall 35 permits the front end 36, collar 32 and body 31 to be bent upwardly as shown in FIG. 4 for easier use and positive dispensing of liquid therefrom to be described.

A crushable ampule 40 is provided within the upper member 14 in chamber 21, which contains liquid 41 to be dispensed, and is preferably constructed of glass, but the ampule can also be constructed of plastic as determined by the characteristics of the liquid to be dispensed. The ampule 40 is of well known type and restrained from movement in chamber 21 by its engagement with the rear wall 42 of body 31, and a downwardly extending wall 43 of collar 32 and wall 35.

Figure 3:
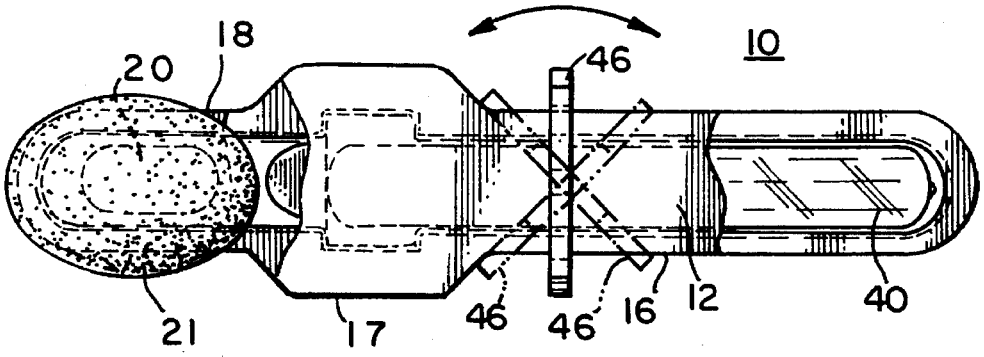
FIG. 3 is a bottom plan view of the device of FIG. 1.
Figure 5:
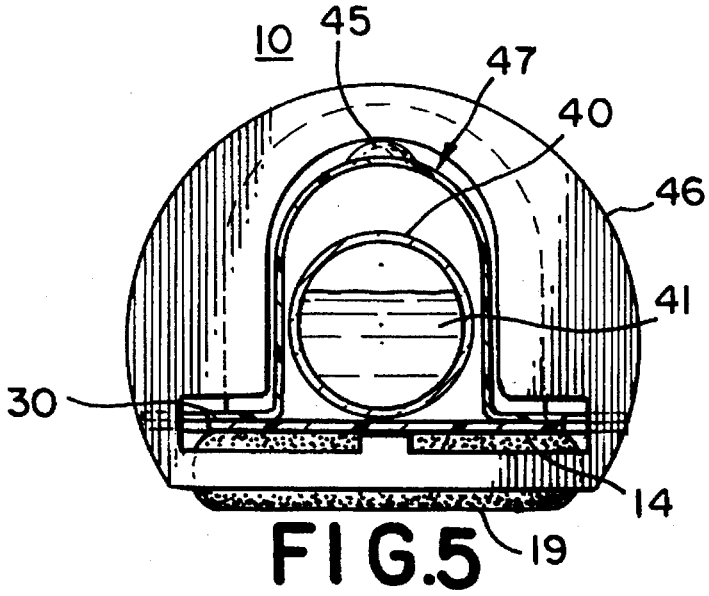
FIG. 5 is a vertical sectional view taken approximately on the line 5—5 of FIG. 2.

The body 31 of upper member 14 rearwardly of collar 32 is provided with a pair of spaced upstanding positioning bumps or projections 45. A slide ring activator 46 is provided normally located between the projections 45, which is of semicircular shape exteriorly, and encircles the upper and lower members 12 and 14. The slide ring activator has an interior opening 47 which fits over the body 31, around the lip 30, and across lower member 12. The slide ring 46 is preferably formed of a suitable plastic, polyvinyl chloride being preferred. The opening 47 in slide ring 46 is greater than the outside dimensions of members 12 and 14, as shown in FIG. 5, to permit it to be rotated as illustrated in FIG. 3, in order to apply force inwardly to glass ampule 40 on both sides to crush the ampule to cause the liquid 41 therein to be released, and flow out opening 20 into sponge 21 for use.

Figure 6:
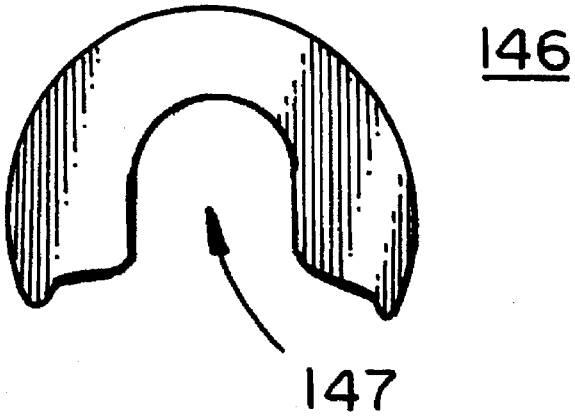
FIG. 6 is a front elevational view of an alternate slide ring.

Referring now to FIG. 6, another embodiment of the slide ring activator 146 is therein illustrated.

The slide ring activator 146 is of "C" shape with an interior opening 147 which fits over the body 31 of upper member 14 between bumps 45, but terminates just past lip 30. The slide ring activator 146 is operated in the same manner as the activator 46 to be described.

Figure 7:
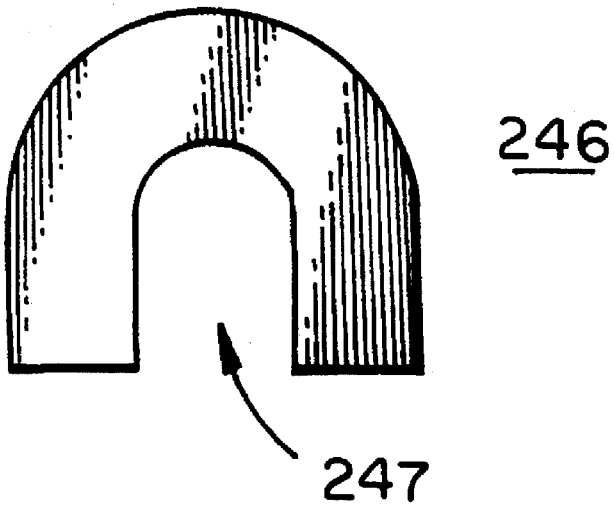
FIG. 7 is a view similar to FIG. 6, but illustrating another slide ring.

Referring now to FIG. 7, another embodiment of the slide ring activator 246 is therein illustrated. The slide ring activator 246 is of "U" shape with an interior opening 247 which fits over the body 31 of upper member 14 between bumps 45. The slide ring activator 247 terminates on top of lip 30, and is operated to crush the ampule 40 in the same twisting manner as activator 46 to be described.

The mode of operation will now be described. In use the applicator device 10 is grasped, for example, by the user's right hand with the front end pointing upwardly, with the sponge 21 upwardly or downwardly oriented as desired. The slide ring activator 46, 146 or 246 is engaged by the thumb and second finger, and rotated for example in a counter clockwise direction which applies forces on each side of ampule 40, which is crushed and liquid 41 is released to flow out opening 20 onto sponge 21 for use. The device 10 can also be held in the left hand, and the slide ring activator 46, 146 or 246 rotated as described above. If desired the device 10 can be bent as illustrated in FIG. 4 to improve liquid flow and ease of application of the liquid thereof by sponge 21 such as to a sheet of glass 50.

It will thus be seen that applicator devices have been provided with which the objects of the invention are achieved.

I claim:

1. An applicator device for selectively dispensing liquids which comprises:

an elongated hollow tube like container, said container having upper and lower members, a chamber in said container, an ampule in said chamber which contains a liquid to be dispensed, a slide ring activator on said container which is capable of rotation thereabout to provide inwardly directed forces on each side of said ampule to crush it to allow liquid to flow thereout, at least one pair of projections on said upper member to longitudinally position said slide ring, said lower member having an opening therein to said chamber to permit liquid to flow thereout, and a sponge applicator secured to said lower member at said opening to receive liquid from said opening for application.

2. An applicator device as defined in claim 1 in which:

said slide ring activator is of semi-circular shape, and encircles said upper and lower members.

3. An applicator device as defined in claim 1 in which said slide ring activator is of "C" shape.

4. An applicator device as defined in claim 1 in which said slide ring activator is of "U" shape.

5. An applicator device as defined in claim 1 in which said ampule is of glass.

6. An applicator device as defined in claim 1 in which said ampule is of plastic.

7. An applicator device as defined in claim 1 in which said upper and said lower members are of plastic.

8. An applicator device as defined in claim 1 in which said slide ring activator is of plastic.

* * * * *